US005266080A

United States Patent [19]

Kiovsky et al.

[11] Patent Number: 5,266,080

[45] Date of Patent: Nov. 30, 1993

[54] METHANOL FUEL CONTAINING FLAME LUMINOSITY AGENT

[75] Inventors: Thomas E. Kiovsky, Solon; Wendy L. Clark, Hudson, both of Ohio

[73] Assignee: The Standard Oil Company, Ohio

[21] Appl. No.: 419,681

[22] Filed: Oct. 11, 1989

[51] Int. Cl.[5] ..... C10L 1/24; C10L 1/22; C10L 1/18

[52] U.S. Cl. ..... 44/312; 44/329; 44/334; 44/335; 44/420; 44/443; 44/445; 44/451; 44/642

[58] Field of Search ..... 44/53, 59, 642, 312, 44/329, 334–335, 420, 443, 445, 451

[56] References Cited

U.S. PATENT DOCUMENTS

| | | | |
|---|---|---|---|
| 46,987 | 3/1865 | Barron | 44/59 |
| 1,557,257 | 10/1925 | Riboisiese | 44/56 |
| 2,046,365 | 7/1936 | Cassidy et al. | 44/59 |
| 2,851,417 | 9/1958 | Ondress | 44/78 |
| 3,049,533 | 8/1962 | Spitzer et al. | 44/59 |
| 3,164,449 | 1/1965 | Buxbaum | 44/59 |
| 3,574,550 | 4/1971 | Scott et al. | 44/59 |
| 4,209,302 | 6/1980 | Orelup | 44/59 |
| 4,473,376 | 9/1984 | Hansen et al. | 44/59 |
| 4,536,188 | 8/1985 | de Witt | 44/59 |
| 4,735,631 | 4/1988 | Orelup | 44/59 |
| 4,764,290 | 8/1988 | Currey | 44/59 |
| 4,932,979 | 6/1990 | Thrasher et al. | 44/1 |

FOREIGN PATENT DOCUMENTS

| | | | |
|---|---|---|---|
| 0127316 | 5/1984 | European Pat. Off. | 44/53 |

OTHER PUBLICATIONS

*The Chemical Process Industries*, Shrene, 2nd Ed., McGraw-Hill, N.Y., 1956, pp. 901 and 913, 918.

*Primary Examiner*—Margaret Medley

*Attorney, Agent, or Firm*—David J. Untener; Michael F. Esposito

[57] ABSTRACT

The flame luminosity of a methanol fuel is appreciably enhanced by the addition thereto of at least one flame luminosity enhancing agent selected from the group consisting of azine dye, triarylmethane dye, fluorescein dye, imine dye and anthraquinone dye, said dye excluding any metal component whose combustion product(s) tend to cause excessive wear in an engine operated with the fuel composition or tend to significantly interfere with normal operation of such engine or any of its associated systems, the flame luminosity of the fuel composition during burning being appreciably enhanced relative to the flame luminosity of the same burning fuel composition but to which no flame luminosity enhancing agent has been added.

29 Claims, No Drawings

METHANOL FUEL CONTAINING FLAME LUMINOSITY AGENT

BACKGROUND OF THE INVENTION

This invention relates to a methanol fuel composition, in particular, one containing a flame luminosity agent.

One of the concerns of employing methanol as a motor vehicle fuel for which it has lately attracted a good deal of attention owing to environmental considerations is that it burns with a light blue flame which readily escapes notice, particularly in daylight or a well lighted area. Because methanol burns with a practically non-luminous flame, its use as a fuel presents a safety hazard which may deter its more widespread use. So, for example, during refueling or in a collision, a methanol-fueled fire might initially go unnoticed presenting a considerable hazard to those in its vicinity.

Nigrosine, an iron-containing azine dye, has been proposed for use as a luminosity agent for fuel which burns with a non-luminous flame. However, due to its heavy metal content, i.e., iron, it is entirely impractical as a luminosity agent for methanol which is intended to be used as a fuel for internal combustion engines. A combustion product of nigrosine, finely divided iron oxide particles, is quite abrasive and may result in an unacceptable rate of engine wear. In addition, fuel additives which contain heavy metals are known to deactivate emission control catalysts.

Another known approach to imparting or enhancing flame luminosity in a methanol-based fuel is to select the hydrocarbon composition of the primer. Such primers are added at 5 to 15 percent with the primary purpose of facilitating engine starting. They may contain gasoline, toluene or reformate. While such materials do provide flame luminosity, they detract from the clean-burning properties of methanol and, as noted in European Patent Application 0 127 316, can lead to problems of water sensitivity.

Another proposal for overcoming the problem associated with the non-luminous burning characteristics of methanol has been the use of 0.5 to 10.0 weight percent trimethyl borate flame luminosity agent as disclosed in U.S. Pat. No. 4,536,188. However, the environmental acceptability of boron-containing combustion products is at present uncertain and, in addition, the characteristic green color imparted to the flame may fail to convey the presence of a hot flame.

SUMMARY OF THE INVENTION

It is a principal object of the present invention to provide a methanol fuel composition containing a flame luminosity agent which is effective at low concentrations and whose combustion products are environmentally acceptable, do not cause catalyst deactivation and do not cause excessive engine wear as in the case of heavy metal-containing combustion products such as the iron oxides.

It is a specific object of the invention to provide such a methanol fuel composition in which the luminosity agent is selected from the group consisting of azine dye, triarylmethane dye, fluorescein-type dye, imine dye and anthraquinone-derived dye, said dye excluding any heavy metal component such as iron.

It is a further specific object of the invention to impart a distinctive color and taste to a methanol fuel composition to distinguish it from a potable liquid by the addition thereto of a dye of the aforesaid type.

It is yet another specific object of the invention to impart enhanced flame luminosity to a methanol composition by the addition thereto of a small amount, e.g., 1 weight percent or less, not exceeding the limits of solubility, of a dye of the aforesaid type.

It is still another specific object of the invention to incorporate a flame luminosity agent into a methanol-containing composition such that the burning composition will exhibit a pale to bright orange flame.

In keeping with these and other objects of the invention, a methanol fuel composition is provided which comprises methanol and a fuel luminosity enhancing amount of at least one flame luminosity enhancing agent selected from the group consisting of azine dye, triarylmethane dye, fluorescein dye, imine dye and anthraquinone dye, said dye excluding any metal component whose combustion product(s) tend to cause excessive wear in an engine operated with the fuel composition or tend to significantly interfere with normal operation of such engine or any of its associated systems, the flame luminosity of the fuel composition during burning being appreciably enhanced relative to the flame luminosity of the same burning fuel composition but to which no flame luminosity enhancing agent has been added.

DESCRIPTION OF THE PREFERRED EMBODIMENTS

The term "methanol fuel" as used herein shall be understood to include pure methanol, the various grades of methanol of commerce and mixtures of methanol and hydrocarbons.

The methanol fuel composition of this invention can be used for a variety of applications but is particularly useful as a fuel for operating an internal combustion engine of the spark ignition or compression ignition type.

The methanol fuel can, in addition to the flame luminosity agent, contain small amounts of one or more other materials which are known to be useful in this type fuel, e.g., antioxidants, corrosion inhibitors, detergents, lubricity agents, octane improvers, etc. Typically, the total amount of such additives besides the flame luminosity agent will be less than about 1 weight percent based on the total volume of the composition. A combustion primer such as light hydrocarbon can be added to the methanol fuel composition of this invention where improved cold starting properties are desired. In most cases, from about 5 to about 15 weight percent primer based on the total weight of the methanol fuel composition can be used with good effect.

It can be advantageous in some cases to add the flame luminosity agent as a solution employing a carrier which is miscible in methanol. Suitable carriers include water; other monoalcohols such as ethanol, propanols, the butanols; polyhydroxyl alcohols such as ethylene glycol, propylene glycol, diethylene glycol, dipropylene glycol; polyoxyalkylene ether polyols such as the polyethylene glycols of up to about 2,500 average molecular weight, a polyester polyol, etc. The use of a carrier to incorporate the flame luminosity agent into the methanol fuel can assist in preventing or lessening the accumulation of azo dye residue on surfaces from which the methanol has evaporated, e.g., the interior surfaces of a carburetor or fuel injection system.

The flame luminosity agent herein can be selected from any one of several specific classes of dyes, namely:

(1) the azine dyes which possess the characteristic essential structure of the phenazinium ion

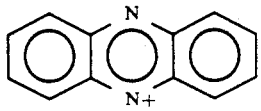

or the phenazthionium ion

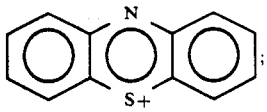

(2) the triarylmethane dyes which possess the characteristic essential structure

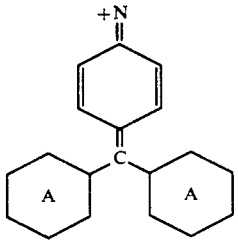

in which either of the

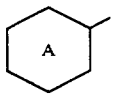

structures represents an aryl ring, e.g., phenyl or naphthyl;

(3) the fluorescein-type dyes which possess the characteristic essential structure

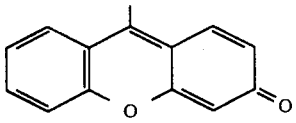

(4) the imine dyes which possess the characteristic essential structure

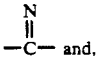

and, (5) the anthraquinone-derived dyes which possess the characteristic essential structure

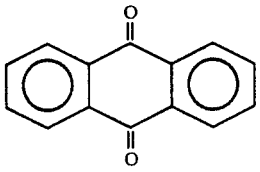

It is of course, necessary, that no dye within the aforedescribed classes which is selected for use herein possess a metal component or species whose combustion products could result in excessive engine wear or significantly interfere with operation of an internal combustion engine or any of its associated systems such as a catalytic converter. Thus, nigrosine which is an iron-containing azine is outside the scope of this invention since its combustion products include iron oxide particles which, as noted above, result in excessive engine wear.

Examples of specific dyes which can be selected from each of the foregoing classes as flame luminosity agents for use herein include:

(1) Azine Dyes (a) the phenazinium ion: Safranine O and Janus Green B; and, (b) the phenazthionium ion: Azure B, Toluidine Blue and Methylene Green (2) Triarylmethane Dyes Patent Blue VF, Guinea Green B, Light Green SF Yellowish, Lissamine Green B and Methyl Green (3) Fluorescein-Type Dyes Fluorescein, Methyl Eosin and Rose Bengal (4) Imine Dyes Auromine O (5) Anthraquinone-Derived Dyes Disperse Blue 14

The flame luminosity agent selected for addition to methanol-based fuel in accordance with this invention must, of course, be incorporated therein in at least a flame luminosity enhancing amount. Ordinarily, the specific amount used should not exceed the limits of solubility of the flame luminosity agent for a particular methanol fuel composition and advantageously should only be that amount which is necessary to impart a reasonable level of enhanced visibility to the burning methanol flame. Simple and routine testing will readily determine the optimum quantity of flame luminosity agent to be used in a given methanol fuel composition. In most cases, the amount of flame luminosity agent which will provide an acceptable flame luminosity enhancing effect is from about 0.01 to about 1, preferably from about 0.02 to about 0.5, and most preferably from about 0.02 to about 0.1, weight percent of the total methanol fuel composition.

The following examples are illustrative of methanol fuel compositions in accordance with this invention.

EXAMPLES 1-15

The dyes shown in the table below were obtained from Aldrich Chemical Co., Milwaukee, Wis. The dyes were dissolved in reagent grade methanol at the concentrations shown and the luminous qualities of the flame were noted by visual observation. Five milliliters of each mixture was burned in a 5 centimeter diameter aluminum foil pan. The colors of the resulting flames ranged from pale orange to bright orange.

TABLE

| Example | Dye | Chemical Type | Concentration, Wt. Percent |
|---|---|---|---|
| 1 | Safranine O | Azine (phenazinium ion) | 0.025 to 0.05 |
| 2 | Janus Green B | Azine (phenazinium ion) | 0.025 to 0.05 |
| 3 | Azure B | Azine (phenazthionium ion) | 0.005 to 0.05 |
| 4 | Toluidine Blue | Azine (phenazthionium ion) | 0.05 |
| 5 | Methylene Green | Azine (phenazthionium ion) | 0.05 |

TABLE-continued

| Example | Dye | Chemical Type | Concentration, Wt. Percent |
|---|---|---|---|
| 6 | Patent Blue VF | Triarylmethane | 0.005 to 0.05 |
| 7 | Guinea Green B | Triarylmethane | 0.005 to 0.05 |
| 8 | Light Green SF Yellowish | Triarylmethane | 0.05 |
| 9 | Lissamine Green B | Triarylmethane | 0.025 to 0.05 |
| 10 | Methyl Green | Triarylmethane | 0.005 to 0.05 |
| 11 | Fluorescein | Fluorescein | 0.005 to 0.05 |
| 12 | Methyl Eosin | Fluorescein | 0.005 to 0.05 |
| 13 | Rose Bengal | Fluorescein | 0.025 to 0.05 |
| 14 | Auromine 0 | Imine | 0.025 to 0.05 |
| 15 | Disperse Blue 14 | Anthraquinone | 0.025 to 0.05 |

What is claimed is:

1. A methanol fuel composition which comprises methanol and a fuel luminosity enhancing amount of at least one flame luminosity enhancing agent selected from the group consisting of azine dye, triarylmethane dye, fluorescein dye and imine dye, said dye excluding any metal component whose combustion product(s) tend to cause excessive wear in an engine operated with the fuel composition or tend to significantly interfere with normal operation of such engine or any of its associated systems, the flame luminosity of the fuel composition during burning is appreciably enhanced relative to the flame luminosity of the same burning fuel composition but to which no flame luminosity enhancing agent has been added.

2. The methanol fuel composition of claim 1 wherein the flame luminosity agent imparts a pale to bright orange color to the flame of the composition during burning of the composition.

3. The methanol fuel composition of claim 1 wherein the flame luminosity enhancing agent is present therein at a level of from about 0.01 to about 1 weight percent.

4. The methanol fuel composition of claim 1 wherein the flame luminosity enhancing agent is present therein at a level of from about 0.02 to about 0.5 weight percent.

5. The methanol fuel composition of claim 1 wherein the flame luminosity enhancing agent is present therein at a level of from about 0.02 to about 0.1 weight percent.

6. The methanol fuel composition of claim 1 wherein the flame luminosity enhancing agent is an azine dye selected from the group consisting of Safranine O, Janus Green B, Azure B, Toluidine Blue and Methylene Green.

7. The methanol fuel composition of claim 1 wherein the flame luminosity enhancing agent is a triarylmethane dye selected from the group consisting of Patent Blue VF, Guinea Green B, Light Green SF Yellowish, Lissamine Green B and Methyl Green.

8. The methanol fuel composition of claim 1 wherein the flame luminosity enhancing agent is a fluorescein dye selected from the group consisting of Fluorescein, Methyl Eosin and Rose Bengal.

9. The methanol fuel composition of claim 1 wherein the flame luminosity enhancing agent is the imine dye Auromine O.

10. The methanol fuel composition of claim 1 further comprising at least one other additive selected from the group consisting of corrosion inhibitor, detergent, antioxidant lubricant, octane improver and combustion primer.

11. The methanol fuel composition of claim 1 further comprising a carrier for the flame luminosity enhancing agent selected from at least one of water, ethanol, propanols, butanols, polyhydroxyl alcohols, and polyoxyalkylene either polyols.

12. The methanol fuel composition of claim 1 further comprising a carrier for the flame luminosity enhancing agent selected from the group consisting of water and hydroxyl-containing compound.

13. The methanol fuel composition of claim 1, wherein said flame luminosity agent is an azine dye comprising a phenazinium ion or a phenazthionium ion.

14. A method for enhancing the flame luminosity of a methanol fuel which comprises adding to the methanol fuel a flame luminosity enhancing amount of at least one flame luminosity enhancing agent selected from the group consisting of azine dye, triarylmethane dye, fluorescein dye and imine dye and, said dye excluding a heavy metal component, the flame luminosity of the fuel composition during burning is appreciably enhanced relative to the flame luminosity of the same burning fuel composition but to which no flame luminosity enhancing agent has been added.

15. The method of claim 14 wherein the flame luminosity enhancing agent imparts a pale to bright orange color to the flame of the composition during burning of the composition.

16. The method of claim 14 wherein the flame luminosity enhancing agent is added to the methanol fuel at a level of from about 0.10 to about 1 weight percent.

17. The method of claim 14 wherein the flame luminosity enhancing agent is added to the methanol fuel at a level of from about 0.02 to about 0.5 weight percent.

18. The method of claim 14 wherein the flame luminosity enhancing agent is added to the methanol fuel at a level of from about 0.02 to about 0.10 weight percent.

19. The method of claim 14 wherein the flame luminosity enhancing agent is an azine dye selected from the group consisting of Safranine O, Janus Green B, Azure B, Toluidine Blue and Methylene Green.

20. The method of claim 14 wherein the flame luminosity enhancing agent is a triarylmethane dye selected from the group consisting of Patent Blue VF, Guinea Green B, Light Green SF Yellowish, Lissamine Green B and Methyl Green.

21. The method of claim 14 wherein the flame luminosity enhancing agent is a fluorescein dye selected from the group consisting of Fluorescein, Methyl Eosin and Rose Bengal.

22. The method of claim 14 wherein the flame luminosity enhancing agent is the imine dye Auromine O.

23. The method of claim 14 further comprising the addition of at least one other additive selected from the group consisting of corrosion inhibitor, detergent, antioxidant, lubricant octane improver and combustion primer.

24. The method of claim 14 further comprising the addition of a carrier for the flame luminosity enhancing agent selected from at least one of water, ethanol, propanols, butanols, polyhydroxyl alcohols and polyoxyalkylene ether polyols.

25. The method of claim 14 further comprising the addition of a carrier for the flame luminosity enhancing agent selected from the group consisting of water and a hydroxyl-containing compound.

26. The method of claim 14, wherein said flame luminosity agent is an azine dye comprising a phenazinium ion or a phenazthionium ion.

27. A methanol fuel composition which comprises methanol and a fuel luminosity enhancing amount of at least one flame luminosity enhancing agent selected from the group consisting of azine dye, triarylmethane dye, fluorescein dye, imine dye and anthraquinone dye, said dye excluding any metal component whose combustion product(s) tend to cause excessive wear in an engine operated with the fuel composition or tend to significantly interfere with normal operation of such engine or any of its associated systems;

the flame luminosity of the fuel composition during burning is appreciably enhanced relative to the flame luminosity of the same burning fuel composition but to which no flame luminosity enhancing agent has been added, and further comprising a carrier for the flame luminosity enhancing agent selected from at least one of polyhydroxyl alcohols and polyoxyalkylene ether polyols, wherein said polyhydroxyl alcohols include at least one of ethylene glycol, propylene glycol, diethylene glycol and dipropylene glycol, and said polyoxyalkylene ether polyols include at least one of polyethylene glycols of up to about 2,500 average molecular weight, and a polyester polyol.

28. A method for enhancing the flame luminosity of a methanol fuel which comprises adding to the methanol fuel a flame luminosity enhancing amount of at least one flame luminosity enhancing agent selected from the group consisting of azine dye, triarylmethane dye, fluorescein dye, imine dye and anthraquinone dye, said dye excluding a heavy metal component, the flame luminosity of the fuel composition during burning is appreciably enhanced relative to the flame luminosity of the same burning fuel composition but to which no flame luminosity enhancing agent has been added, and further comprising the addition of a carrier for the flame luminosity enhancing agent selected from at least one of polyhydroxyl alcohols and polyoxyalkylene ether polyols, wherein said polyhydroxyl alcohols include at least one of ethylene glycol, propylene glycol, diethylene glycol and dipropylene glycol, and said polyoxyalkylene ether polyols include at least one of polyethylene glycols of up to about 2,500 average molecular weight, and a polyester polyol.

29. The method of claim 28 wherein the flame luminosity agent is the anthraquinone dye Disperse Blue 14.

* * * * *